US005388518A

United States Patent [19]

Wong

[11] Patent Number: 5,388,518

[45] Date of Patent: Feb. 14, 1995

[54] PROPELLANT FORMULATION AND PROCESS

[75] Inventor: James Wong, Wayland, Mass.

[73] Assignee: Composite Materials Technology, Inc., Shrewbury, Mass.

[21] Appl. No.: 269,884

[22] Filed: Nov. 10, 1988

[51] Int. Cl.[6] ..... C06D 5/06; C06B 33/00

[52] U.S. Cl. ..... 102/289; 102/290; 149/37; 149/38; 149/114

[58] Field of Search ..... 102/289, 290; 149/37, 149/38, 114

[56] References Cited

U.S. PATENT DOCUMENTS

| | | | |
|---|---|---|---|
| 3,784,419 | 1/1974 | Baumann et al. | 149/38 X |
| 4,001,057 | 1/1977 | Baldwin et al. | 149/38 X |
| 4,380,482 | 4/1983 | Sandell et al. | 149/38 X |
| 4,424,086 | 1/1984 | Christopher | 149/37 X |
| 4,530,728 | 7/1985 | Sayles | 149/38 X |
| 4,756,251 | 7/1988 | Hightower, Jr. et al. | 102/289 |
| 4,764,229 | 8/1988 | Miekka et al. | 149/38 X |

*Primary Examiner*—Peter A. Nelson

*Attorney, Agent, or Firm*—Hayes, Soloway, Hennessey, Grossman & Hage

[57] ABSTRACT

The present invention relates to metal filaments for use as fuel additives for rocket propellants, explosives, and other pyrotechnic devices. Preferred filaments are those such as zirconium, niobium and titanium (and alloys thereof) which have very high heat of combustion.

10 Claims, No Drawings

PROPELLANT FORMULATION AND PROCESS

PROPELLANT FORMULATION AND PROCESS

The present invention relates to metal filaments for use as fuel additives for rocket propellants, explosives, and other pyrotechnic devices. Preferred filaments are those such as zirconium, niobium and titanium (and alloys thereof) which have very high heat of combustion.

In rocket propellants, grenades, and various explosive devices, metal powders are often added to increase the overall heat of combustion and otherwise control the rate of burning of a propellant or explosive. (For example, "Metal Powders for Fuel Propellant, Pyrotechnics, and Explosives" Fauth, pp 597–605, and "Explosivity and Pyrophoricity of Metal Powders" Dahn, pp 194–200, ASM Handbok Vol. 7, 1984.) While zirconium and similar powders have been employed in the past, they are extremely hazardous to use due to the pyrophoricity of zirconium powders and the tremendous heat generated by the burning of such powders. Known techniques for producing such zirconium powders involve reduction processes which provide a fairly wide range of particle sizes, some of which can be extremely fine and almost impossible to handle under conditions other than completely inert ambient atmospheres. Also, the wide range of particle sizes which result from most processing operations can give undesirable burning characteristics which are more difficult to predict and control. The normal methods for the formation of powders involve continued mechanical diminution (i.e. grinding, ball milling, impact crushing, etc.) all produce particles which are extremely non-uniform, irregular and contaminated. These methods often form "dust" (e.g. airborne sub particles). This is the nature of these processes. The powder becomes more dangerous to handle as the particles get smaller, and the degree of surface contamination also increases, resulting in variability in ignition and spontaneous combustion problems. Due to the fact that sub micron powders are subject to agglomeration the actual surface area could be considerably larger than if we assume the particles are separate solid spheres and thus create unpredictable performance.

The most common metal used is Aluminum as an addition to solid rocket propellant and explosive devices. The amount of Aluminum can be up to 20% of the total charge. Other metals are also used and these are Magnesium, Titanium and Zirconium. These metals are generally added in form of very fine particles or powders. In most cases however, the full utilization of the theoretical performance of these metal additions has not been achieved for a variety of reasons. In general, the main factors which govern the performance are the same parameters which control the ignition and subsequent combustion of the metal particles. The rate of combustion of the metal vary from burning (Deflagration) to very rapid detonation of the metal as in explosives. These factors are:

1. Size and shape of the metal in fine dispersion.
2. Surface area/volume ratio.
3. Chemical purity of the bulk metal and its surface.
4. The real and apparent density of the metal.
5. Surface contamination resulting from processing or for safety reasons.
6. Nature of the prepared surfate which relates to the method of preparation . . . i.e. made by ball milling, grinding or various chemical or electro-chemical methods.
7. The physical properties such as melting point (in the case of Aluminum, the low melting point results in both particle agglomeration and melting prior to ignition and combustion).

Considerable attention has been spent on optimization of the fuel, oxidizer and binder portions of rocket and explosive devices. In all cases, the metal addition has not received similar attention. As a result, what has been available has been essentially what the powder metallurgy industry can produce and this has resulted in less than desired performance. The following are the most desirable characteristic for metal fuel additions:

1. Metals which are uniform in both size and shape such that reliable reproducible ignition and complete combustion can take place.
2. The metal should be produced in very fine state of dispersion.
3. The metal should be completely dense and not porous or agglomerated powders.
4. The surface of the bulk metal should be of high purity, free of contaminants.
5. Very little size variation to minimize the danger of handling and processing.
6. The metal can be manufactured economically and safely in large quantities.

SUMMARY OF THE PRESENT INVENTION

In the present invention the disadvantages of metal powders, such as zirconium, used in the past for additives to fuel propellants and explosives are overcome by providing elongated cylindrical metal particles having essentially uniform filament diameters. These particles have very predicable surface area to volume ratios which are independent of particle length (at length to diameter ratios in excess of 1,000) and dependent only on cylinder diameter. In the use of solid finely dispersed powders, one assumes that the main variable that is important, in ignition and combustion of the powder particles, is the surface area to volume ratio. This means that as the particles are reduced in size, the surface to volume ratio also increases. As the particle size decreases, and when the particles are exposed to atmosphere $O_2$ and $N_2$, surface reaction occurs with heat being generated. If this heat is not dissipated, spontaneous combustion can occur. In much the same way ignition and subsequent combustion occurs in rocket fuels and explosives.

As a first approximation of the surface area to volume ratio of powder particle we can assume a solid sphere. The surface area to volume ratio for both a solid sphere and that of a filament can be compared: Taking this ratio, the following relationship can be proven.

$$\frac{6}{Ds} = \frac{4}{Df} + \frac{2}{\text{Length of Filament}}$$

(Where Ds is the Diameter of a sphere and Df is the diameter of the filament.)

For lengths which are many times longer than the diameter (e.g. 1,000 times) the surface to volume relationship is essentially:

$Df = \frac{2}{3} Ds$

Thus a filament diameter has only to be $\frac{2}{3}$ that of a sphere to give the same surface area/volume ratio.

Note that a sphere has minimum surface for a given volume; thus a cylinder or filament has more surface for the same volume. Thus a 3 micron particle has the same ignition and combustion properties as a 2 micron filament.

While it is preferred that the elongated particles be essentially cylindrical in cross section, they may have other cross sectional shapes, such as hexagonal, eliptical, or partially flattened. In any case, the particles should be uniform, having predictable and controlled surface to volume ratios which provide predetermined and predictable burning rates when the particles are used as additives to propellants and explosives. These elongated metal (e.g. zirconium) particles are preferrably produced by the same metallurgical technique which is used for producing superconducting filaments in a copper matrix such as the type of filament generally described in a recent article by Valaris et al published at the Applied Super Conductivity Conference, August 1988, San Francisco. Since the filaments are all surrounded by a ductile metal matrix—such as copper, none of the filaments are exposed to any exterior atmosphere environment. The total uniformity of each filament exceeds ±.1 micron in diameter, as can be seen by the SEM pictures. Furthermore the filaments are solid, as opposed to powders. Therefore, these filaments can be safely handled-until ready to use. In use the copper matrix can be safely removed using HNO3. Since the filaments are under liquid, the acid can be flushed out and replaced by water safely and, in this way, the filaments never experience exposure to the atmosphere.

This process can be used to produce alloy filaments such as Niobium Titanium—This can also be used to produce composite filaments where the surface can be one metal while the core is another. For example the core can be Zirconium with an Aluminum surface or Zirconium with a Niobium surface where the Niobium would have lower ignition properties than Zirconium. The reverse could be used where the Niobium could be the core and the heat of combustion would be high. The heat of combustion of Niobium is −460,000 g-cal/mol as compared to Zirconium of −262,980 g-cal/mol. Thus various combinations of metals can be combined to give the most desired performance.

The fact that filaments are produced is a significant advantage in it's use for rocket fuels. The filaments, either continuous or chopped filaments, can be used to reinforce the normal rocket propellant which can crack or deform during use or as a result of aging.

These filament forming techniques have been widely used as described in numerous patents such as Roberts U.S. Pat. No. 3,698,863. Additional modifications of the above technology have been employed for the manufacture of metal filaments as illustrated in Webber et al patents 3,277,564; 3,379,000 and Roberts 3,394,213 and Yoblin 3,567,407. All of these processes will produce metal filaments of controlled and uniform cross section. Several patents dealing with the capacitor art, such as Douglass 3,742,369 and Fife 4,502,884 describe metalic compacts of valve metal powder (which may include titanium and zirconium) impregnated with a softer metal such as copper which are then reduced in size to form valve metal fibers of small cross sections. However, these processes, while useful for capacitor purposes, do not provide uniform fiber diameters.

SPECIFIC DESCRIPTION OF THE INVENTION

EXAMPLE I

In one preferred embodiment of the invention the following steps were employed.

The procedure described by Roberts U.S. Pat. No. 3,698,263 is used to produce zirconium filaments of 2.5 microm diameter (cross-section). These filaments were chopped to a length of about 1 centimeter and then added to the following formulation to provide a rocket propellant fuel:

| Component | Wt % |
|---|---|
| Double Based Nitrocellulose and nitroglycerin | 45% |
| Ammonium perchlorate | 35% |
| Zirconium filaments | 20% |

EXAMPLE II

The filaments of Example I were added to the following formulation to provide an explosive:

| Component | Wt % |
|---|---|
| RDX | 21% |
| Amononium Nitrate | 21% |
| TNT | 40% |
| Zirconium filaments | 18% |

The basic propellant and explosive formulations are those in ASM Vol. 7 "Powder Metal Handbook" (1984) pp 600–601.

While preferred embodiments of the invention have been described above numerous modifications thereof may be employed. For example, the resultant elongated zirconium filament may be produced in hexagonal cross section as described in the Valaris et al article or may be partially flattened during final processing operations, but in any case, the principal requirement of the processing steps is that the resultant filaments have a controlled and known surface to volume ratio which is independent of length.

When the metal filament is one formed of a metal other than zirconium it can be produced using the same mechanical working techniques. In fact, niobium titanium superconducting filament produced in accordance with the above-mentioned prior patents can be used as propellant additives after removal of the copper matrix usually employed.

An additional advantage of the use of the highly combustible metal filaments is that they serve as reinforcements to the propellant mix, thus permitting the propellant to better withstand high G forces and high temperatures.

The filaments can also be provided with coatings or cores to lower or raise the heat of combustion of the filaments, to lower or raise the melting point, or modify the ignition temperature of the filament.

The filaments can also be produced by the method described by McDonald in U.S. Pat. No. 4,414,428 wherein a mesh of the reactive metal is formed in Jelly roll with a layer of copper to provide a structure that can be reduced to form filaments of substantially uniform cross section throughout most of their length.

I claim:

1. The process of forming a propellant or other explosive device which comprises adding to the normal organic propellant oxidizer a substantial weight of metal filaments from the group consisting of Aluminum, Zirconium, Titanium, and Niobium and alloys thereof having predetermined substantially uniform surface to volume ratios, the metal filaments having at least one dimension less than 10 microns.

2. An explosion device such as a propellant comprising a normal organic propellant and oxidizer and a substantial weight of metal filaments from the group consisting of Aluminum, Zirconium, Titanium, and Niobium and alloys thereof having predetermined substantially uniform surface to volume ratios, the metal filaments having at least one dimension less than 10 microns.

3. The process of claim 1 wherein the metal comprises Zirconium.

4. The process of claim 1 wherein the metal filaments have a coating of another material which modifies the ignition rate of the filament.

5. The process of claim 4 wherein the coating increases the rate of ignition and combustion.

6. The process of claim 4 wherein the coating lowers the rate of ignition and combustion.

7. The process of claim 4 wherein the coating has a melting point higher than that of the base metal of the filament.

8. The process of claim 4 wherein the coating has a melting point lower than that of the base metal of the filament.

9. The process of claim 4 wherein the coating modifies the ignition temperature of filament.

10. The process of claim 1 wherein the variation of filament diameter is on the order of $\pm 0.1$ micron.

* * * * *